US005980222A

United States Patent [19]

Fry

[11] Patent Number: 5,980,222

[45] Date of Patent: Nov. 9, 1999

[54] HERMETIC RECIPROCATING COMPRESSOR HAVING A HOUSING DIVIDED INTO A LOW PRESSURE PORTION AND A HIGH PRESSURE PORTION

[75] Inventor: Emanuel D. Fry, Tecumseh, Mich.

[73] Assignee: Tecumseh Products Company, Tecumseh, Mich.

[21] Appl. No.: 08/969,631

[22] Filed: Nov. 13, 1997

[51] Int. Cl.[6] ..... F04B 39/10

[52] U.S. Cl. ..... 417/553; 417/552; 417/523; 417/312; 184/6.6; 184/6.18

[58] Field of Search ..... 417/312, 523, 417/552, 553; 184/6.6, 6.18

[56] References Cited

U.S. PATENT DOCUMENTS

| | | | |
|---|---|---|---|
| 1,470,769 | 10/1923 | Shaw | 184/6.6 |
| 2,178,425 | 10/1939 | Johnson | 230/210 |
| 2,963,113 | 12/1960 | Ayling | 184/6 |
| 3,203,353 | 8/1965 | Ruby | 103/87 |
| 3,385,515 | 5/1968 | Parker | 230/232 |
| 3,396,903 | 8/1968 | Iwao Oya | 230/58 |
| 3,462,075 | 8/1969 | Dirk et al. | 230/232 |
| 3,689,203 | 9/1972 | Vaughn | 417/371 |
| 3,698,840 | 10/1972 | Hover | 417/312 |
| 3,817,661 | 6/1974 | Ingalls | 417/312 |
| 3,876,339 | 4/1975 | Gannaway | 417/312 |
| 3,922,114 | 11/1975 | Hamilton et al. | 417/366 |
| 3,924,968 | 12/1975 | Gaines | 417/53 |
| 3,926,009 | 12/1975 | Parker et al. | 62/296 |
| 3,934,967 | 1/1976 | Gannaway | 417/271 |
| 4,058,361 | 11/1977 | Giurlando et al. | 417/312 |
| 4,273,519 | 6/1981 | Gannaway | 417/273 |
| 4,316,705 | 2/1982 | Siewert | 417/273 |
| 4,371,319 | 2/1983 | Murayama et al. | 417/312 |
| 4,474,541 | 10/1984 | Siewert | 417/273 |
| 4,487,555 | 12/1984 | Ohinata et al. | 417/312 |
| 4,518,323 | 5/1985 | Elson et al. | 417/312 |
| 4,534,710 | 8/1985 | Higuchi | 417/269 |
| 4,652,217 | 3/1987 | Shibuya | 417/269 |
| 4,690,619 | 9/1987 | Iijima | 417/269 |
| 4,813,852 | 3/1989 | Ikeda | 417/269 |
| 4,834,632 | 5/1989 | Gatecliff et al. | 417/534 |

(List continued on next page.)

FOREIGN PATENT DOCUMENTS

| | | |
|---|---|---|
| 3-96693 | 4/1991 | Japan . |
| 5-10268 | 1/1993 | Japan . |

*Primary Examiner*—Charles G. Freay
*Assistant Examiner*—Ehud Gartenberg
*Attorney, Agent, or Firm*—Baker & Daniels

[57] ABSTRACT

A compressor assembly includes a compressor mechanism mounted within a hermetically sealed housing. The housing is effectively divided into a low pressure area at a relatively low temperature and a high pressure area at a relatively high temperature. A motor and a lubrication system are contained within the low pressure area and the discharge side of the compressor mechanism is disposed in the high pressure area. A cylinder block effectively separates the high and low pressure areas of the compressor. The lubrication system includes an axial passage for communication oil from a sump to various compressor components, including rotational bearings. A seal cap is disposed at the end of the crankshaft that extends into the high pressure area and in combination with the cylinder block defines an oil discharge chamber at low pressure and isolated from the high pressure area. A second vent passage formed in the upper end portion of the crankshaft provides a communication path between a suction cavity formed in the compressor mechanism and the oil discharge chamber within the seal cup. A pressure drop caused by the reciprocating action of the pistons in the compressor mechanism occurs at the oil discharge area formed in the seal cup thereby assisting the oil pump in drawing oil through the oil passage in the crankshaft. An acoustic insulator is provided intermediate the compressor mechanism and a mounting flange to isolate and reduce vibration and noise which occurs during compressor operation.

19 Claims, 5 Drawing Sheets

U.S. PATENT DOCUMENTS

| | | | |
|---|---|---|---|
| 4,836,754 | 6/1989 | Ikeda | 417/269 |
| 4,838,769 | 6/1989 | Gannaway | 417/312 |
| 4,842,492 | 6/1989 | Gannaway | 417/312 |
| 4,930,995 | 6/1990 | Suzuki | 417/312 |
| 4,988,269 | 1/1991 | Blass | 417/312 |
| 5,180,292 | 1/1993 | Abousabha et al. | 417/273 |
| 5,232,351 | 8/1993 | Robertson et al. | 417/368 |
| 5,288,211 | 2/1994 | Fray | 417/312 |
| 5,354,182 | 10/1994 | Niemiec et al. | 417/363 |
| 5,464,332 | 11/1995 | Beck et al. | 417/368 |
| 5,476,371 | 12/1995 | Dreiman et al. | 418/550 |
| 5,498,143 | 3/1996 | Dreiman et al. | 418/55.1 |
| 5,505,596 | 4/1996 | Nakamura et al. | 418/55.6 |
| 5,591,018 | 1/1997 | Takeuchi et al. | 417/366 |
| 5,690,475 | 11/1997 | Yamada | 417/32 |
| 5,785,151 | 7/1998 | Fry et al. | 184/6.16 |

HERMETIC RECIPROCATING COMPRESSOR HAVING A HOUSING DIVIDED INTO A LOW PRESSURE PORTION AND A HIGH PRESSURE PORTION

BACKGROUND OF THE INVENTION

The present invention relates generally to hermetic compressor assemblies and, more particularly, to compressors that are divided into separate discharge or high pressure and suction or low pressure sections.

Hermetic compressors comprise a hermetically sealed housing having a compressor mechanism, motor, and various related parts mounted therein. The compressor mechanism typically includes a crankcase, also referred to as a cylinder block in rotary and reciprocating piston type compressors, which defines at least one compression chamber in which gaseous refrigerant is compressed and subsequently discharged into a common discharge cavity. Suction gas at low pressure is drawn into the housing of the compressor and is delivered to the compressor mechanism where the suction gas is compressed by the reciprocating piston in the cylinder and discharged at discharge pressure into a discharge cavity and ultimately out of the compressor housing. Gas at suction pressure is maintained separate from the discharge gas. Some compressors are referred to as high-side units, in which the housing is generally at discharge or high pressure, i.e. discharge gas occupies the space defined by the housing. Other compressors are referred to as low-side units, in which the housing is generally at suction or low pressure, i.e. suction gas occupies the space defined by the housing. Although high side machines offer a more attractive environment from the standpoint of flow of lubricating oil throughout the compressor, a problem associated with high side machines is that with the motor surrounded by high temperature discharge gas, the operating efficiency of the motor and the compressor are lessened.

SUMMARY OF THE INVENTION

The present invention provides an improved hermetic compressor arrangement wherein an internal baffle system provides an improved separation of low and high pressure chambers or sections within the compressor housing. In the compressor of the present invention, a valve plate and piston combination divides the compressor into a low pressure area and a high pressure area. The motor, oil sump, and lubrication system are located in the low pressure area and are surrounded by low suction pressure fluid. The suction pressure fluid is at a lower temperature than the high pressure discharge fluid. By placing the motor, sump, and lubrication system in the low suction pressure area, the temperature of the lubricating oil, and therefore the temperature of the bearings lubricated therewith, and the operating temperature of the motor are reduced, while the high temperature portion of the compressor, cylinder head, valve plate, etc., is in the discharge portion of the system. This provides a means for allowing the heat of compression to be dissipated to the condenser side of the system as opposed to the evaporator or low side of the system. This results in prolonged bearing life and optimized motor reliability and performance, while optimizing the thermal efficiency of the compressor.

Two principal factors result in enhanced oil flow through the compressor; 1) centrifugal force generated by fan-like blades provided at the top of the rotor causes the oil to be flung outward against the motor windings to be returned to the oil sump in the bottom of the housing, and 2) the combination of a seal cup at the upper end of the crankshaft, and a secondary bore formed in the upper end of the crankshaft and in communication with the yoke cavity. The seal cup and crankshaft form an area at suction pressure. This combination operates to aid in drawing oil up through the oil passage due to a natural pressure drop that occurs from the oil passage to the yoke cavity from the lower housing suction. The pressure drop between the oil passage and the yoke cavity is primarily a result of the reciprocating action of the pistons which draw suction fluid from the yoke cavity. Centrifugal force directs lubricating oil outward from the oil passage into lateral radial passages formed in the crankshaft to lubricate bearings along the length of the crankshaft. An orifice device, such as a bolt or plug with a hollow bore therethrough, is placed in the secondary bore to act as a dam to prevent oil slung against the inner surface of the seal cup from traveling into the secondary bore and into the yoke cavity, unless the area formed by the seal cap and the upper surface of the crankshaft becomes flooded with oil. Lubricating oil slung against the inner surface of the seal cup travels downward along the rotational bearing provided at the upper end of the crankshaft.

During compressor operation, refrigerant travels from the low suction pressure area surrounding the motor to the low pressure area in the yoke cavity via the annular space provided between the muffler or baffle plate and the crankcase shaft hub. Fan blade-like protuberances, located on the top of the rotor facing the muffler plate, create a centrifugal effect that acts upon liquid refrigerant and oil mixture which may occur during liquid flooding conditions forcing it outward between a gap formed between the stator and the muffler plate and ultimately into the area within the lower housing. This enhances compressor operation and reliability by reducing liquid slugging during abnormal flooding conditions and prompts high circulation rates.

The high/low pressure compressor of the present invention provides an environment in which the motor and lubrication system are operating at system low or suction pressure condition, which provides for both a cool efficient motor and cool operating lubrication system. The high temperature portion of the compressor, the compressor mechanism, is in the discharge portion of the system. This provides for a means of allowing the heat of compression to be dissipated to the condenser side of the system as opposed to the evaporator or low side of the system.

In addition, the present invention involves providing an annular acoustic insulation device intermediate the crankcase and an annular welding ring, which is now to be placed at the intersection of the lower and upper housing members to hermetically seal same together. The acoustic insulator may be mechanically or otherwise bonded or secured to the crankcase and the annular welding flange, and forms a part of the high to low pressure seal. By way of example and not limitation, acceptable bonding methods include ultrasonic welding, solvent welding, acrylic adhesive, and hot metal bonding. The acoustic insulator may be made from such materials as neoprene-based elastomers, butylene-type elastomers, silicon-based elastomers, dense fiber type elastomers, etc. During normal operation the insulator prevents the crankcase from engaging the welding ring and deflects so as to absorb loads associated with compressor operation. The insulator isolates vibrations from the crankcase and reduces the communication of same to the housing. Should the insulator experience an excessive load, the crankcase and welding flange my touch, however sufficient clearance is provided between the insulator and the inner surface of the housing to prevent the insulator from engaging the housing and rubbing thereagainst. The elastomer-based insulator has memory and essentially returns to its normal, pre-load shape once a load dissipates.

The invention, in one form thereof, provides a hermetic compressor including a hermetically sealed housing having an oil sump therein, a compressor unit, a motor, and a lubrication system. The compressor unit is disposed in the housing and is adapted to receive and compress refrigerant fluid at a suction pressure and discharge compressed refrigerant fluid at a discharge pressure. The motor includes a stator and a rotor rotatably connected to a crankshaft that is drivingly connected to the compressor unit. The lubrication system includes an oil pump that is adapted to communicate oil from the oil sump to at least one oil outlet, which is adapted to deliver lubricating oil to the compressor unit. The compressor unit is adapted to separate the housing into a high pressure area, essentially at discharge pressure, and a low pressure area, essentially at suction pressure. The motor and lubrication system are disposed in said low pressure area, and the compressor unit discharges compressed refrigerant fluid into the high pressure area.

The invention further provides a hermetic compressor including a hermetically sealed housing having a first housing shell and a second housing shell, a compressor unit, a motor, a welding flange and an acoustic insulator. The compressor unit is disposed in the housing and is adapted to receive and compress refrigerant fluid at a suction pressure and discharge compressed refrigerant fluid at a discharge pressure. The motor includes a stator and a rotor rotatably connected to a crankshaft that is driving connected to the compressor unit. The welding flange is connected to the first and second housing shells to provide a hermetically sealed housing assembly. An acoustic insulator is interposed between the compressor unit and the welding flange and is made from a vibration absorbing material. The insulator reduces the communication of vibrations from the compressor unit to the housing during compressor operation.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
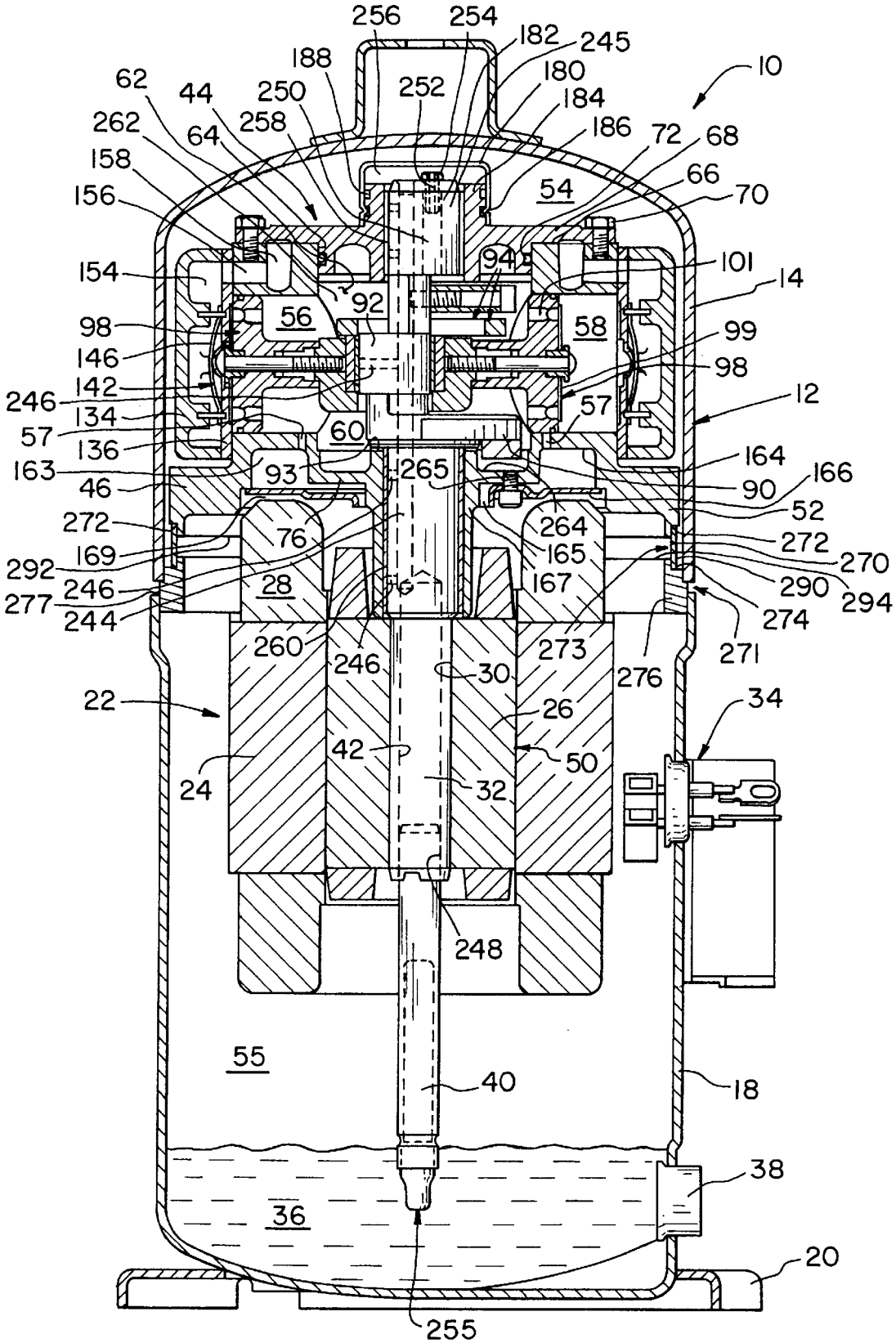
FIG. 1 is a longitudinal sectional view of a compressor incorporating the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

In an exemplary embodiment of the invention as shown in the drawings, and in particular by referring to FIG. 1, a scotch yoke type compressor assembly 10 is shown having a housing generally designated at 12. The rotation of the crankshaft is converted to a reciprocation motion by means of a scotch yoke mechanism so as to drive the four-cylinder compressor mechanism illustrated in the drawings. One prior compressor of this type is illustrated in U.S. Pat. No. 5,288,211 (Fry), which is hereby incorporated into this document by reference and which is assigned to the assignee of the present invention. Another such compressor is disclosed in U.S. Pat. No. 4,842,492 (Gannaway) which is also assigned to the assignee of the present invention.

Housing 12 has a top portion 14 and a bottom portion 18. The two housing portions are hermetically secured together as by welding or brazing. A mounting flange 20 is welded to the bottom portion 18 for mounting the compressor in a vertically upright position.

Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided for connecting the compressor to a source of electric power.

Compressor assembly 10 also includes an oil sump 36 located in bottom portion 18. Oil sight glass 38 is provided in the sidewall of bottom portion 18 to permit viewing of the oil level in sump 36. A centrifuigal oil pick-up tube 40 is press fit into a counterbore 42 in the end of crankshaft 32.

Also enclosed within housing 12, in the embodiment shown in FIG. 1, is a scotch yoke compressor mechanism generally designated at 44. A description of a basic scotch yoke compressor design is given in U.S. Pat. No. 4,838,769 assigned to the assignee of the present invention and expressly incorporated by reference herein.

Compressor mechanism 44 comprises a crankcase or cylinder block 46 including a plurality of mounting lugs to which motor stator 24 is attached such that there is an annular air gap 50 between stator 24 and rotor 26. The lower portion 52 of crankcase 46 divides the interior of housing 12 into an upper chamber 54 at high or discharge pressure in which the compressor mechanism 44 is mounted, and a lower chamber 55 at low or suction pressure in which motor 22 is disposed. Axial passages 57 extend through crankcase 46 to provide communication between yoke cavity 262 and lower chamber 55, via suction muffler baffle plate 166, discussed in detail below.

Compressor mechanism 44, as illustrated in one typical embodiment, takes the form of a reciprocating piston, scotch yoke compressor. More specifically, crankcase 46 includes four radially disposed cylinder bores or compression chambers 58. Crankcase 46 may be constructed by conventional casting techniques. The four radially disposed cylinder bores open into and communicate with a central suction cavity 60 defined by inside cylindrical wall 62 in crankcase 46. A relatively large pilot hole 64 is provided in a top surface 66 of crankcase 46. Various compressor components, including crankshaft 32, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, and O-ring seal 72 isolates suction cavity 60 from a discharge pressure space defined by upper chamber 54 of housing 12.

Crankshaft 32 is rotatably journalled in crankcase 46, and extends through suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 98, representative of four radially disposed piston assemblies operable in compressor mechanism 44, are associated with cylinder bores 58.

Compressed refrigerant within each cylinder bore 58 is discharged through valve plate 136. With reference to cylinder 58 in FIG. 1, a cylinder head 134 is mounted to crankcase 46 with valve plate 136 interposed therebetween. A valvee plate gasket (not shown) is provided between valve plate 136 and crankcase 46. Discharge valve assembly 142 is situated on the top surface of valve plate 136. Generally, compressed gas is discharged through valve plate 136 and past a discharge valve 146.

A discharge chamber 154 is defined by the space between the top surface of plate 136 and the underside of cylinder head 134. Discharge gas within discharge chamber 154, associated with each respective cylinder, passes through a respective connecting passage 156 in crankcase 46. Connecting passage 156 provides communication from discharge chamber 154 to a top annular muffling chamber 158. Top muffling chamber 158, common to and in communication with all of the discharge chambers 154, is defined by an annular channel formed in the top surface of crankcase 46 and a top cover portion of bearing 68. Connecting passage 156 passes not only through crankcase 46, but also through holes in valve plate 136 and the valve plate gasket.

Figure 7:
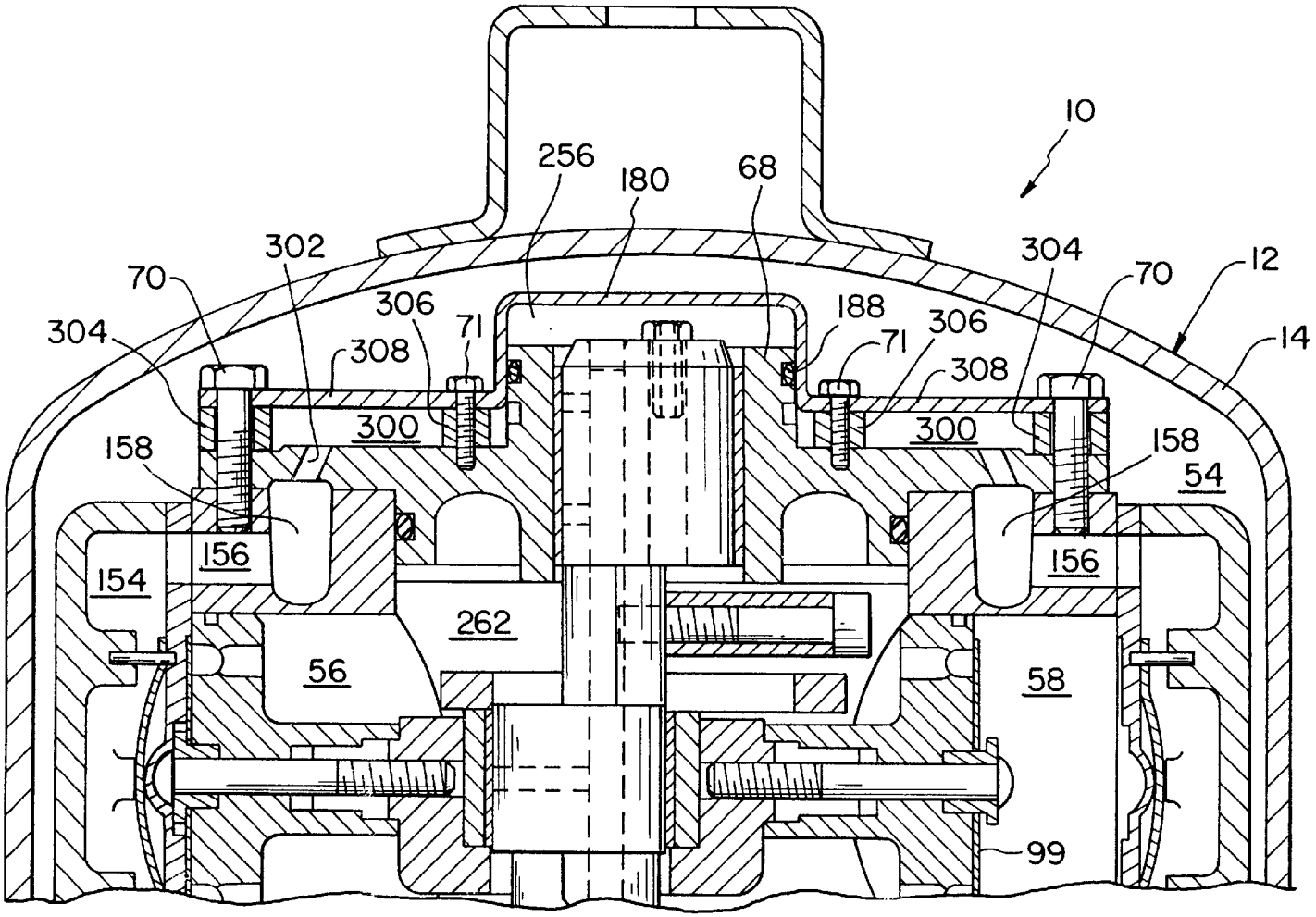
FIG. 7 is a partial sectional view illustrating an alternative upper bearing arrangement having a secondary discharge muffling chamber for use with the compressor of FIG. 1.

FIG. 7 illustrates an alternative arrangement for bearing 68 in which secondary discharge muffling chamber 300 is provided for additional muffling to further quiet compressor operation. In the particular embodiment shown, passage 302 is provided in bearing 68 intermediate primary discharge muffling chamber 158 and secondary muffling chamber 300 to communicate discharge fluid therethrough. Secondary muffling chamber 300 is defined by bearing 68, concentric annular body or wall 304, lower wall portion of seal cap 180, and chamber cover 308. Bolts 70 secure cover 308 and annular wall 304 to bearing 68. In this alternative arrangement, exit ports 161 (FIG. 5) may be formed in secondary muffling chamber 300. Exit ports 161 are in fluid communication with upper chamber 54. Although the alternative arrangement for secondary muffling chamber 300 is shown utilizing a two-piece construction, it should be understood that the secondary muffling chamber may be formed by using a three-piece approach, e.g., a second inner annular wall is provided about separate and independent seal cup 180, a one piece approach, wherein wall 304, cover 308, and a second annular wall or seal cup 180 are integral one with the other, or any of a number of arrangements. Further, seal cup 180 may be rendered unnecessary by forming suction pressure area 256 directly in bearing 68, which may be integral with secondary muffling chamber cover 308.

An internal baffling system, not shown, may be located within primary discharge muffling chamber 158. The baffle arrangement may include baffles, preferably formed by web members on crankcase 46, that divide muffling chamber 158 into a plurality of sub-chambers. The baffles partially separate the discharge valve assemblies 142 from each another and include a top wall that is spaced away from the top cover portion of bearing 68 to permit refrigerant to flow between the sub-chambers. The top wall is spaced away from the top cover portion to create a restricted opening or clearance passage in which compressor cross talk or pressure pulses are throttled and reduced. Additionally, pressure pulses traveling out of passage 156 impact the baffles and are reduced in magnitude.

Figure 2:
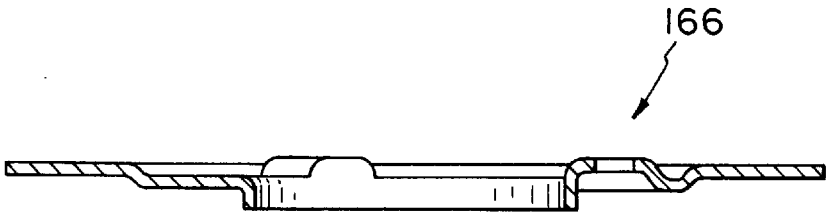
FIG. 2 is a cross-sectional view of the suction pressure baffle plate incorporated in the compressor of FIG. 1.
Figure 3:
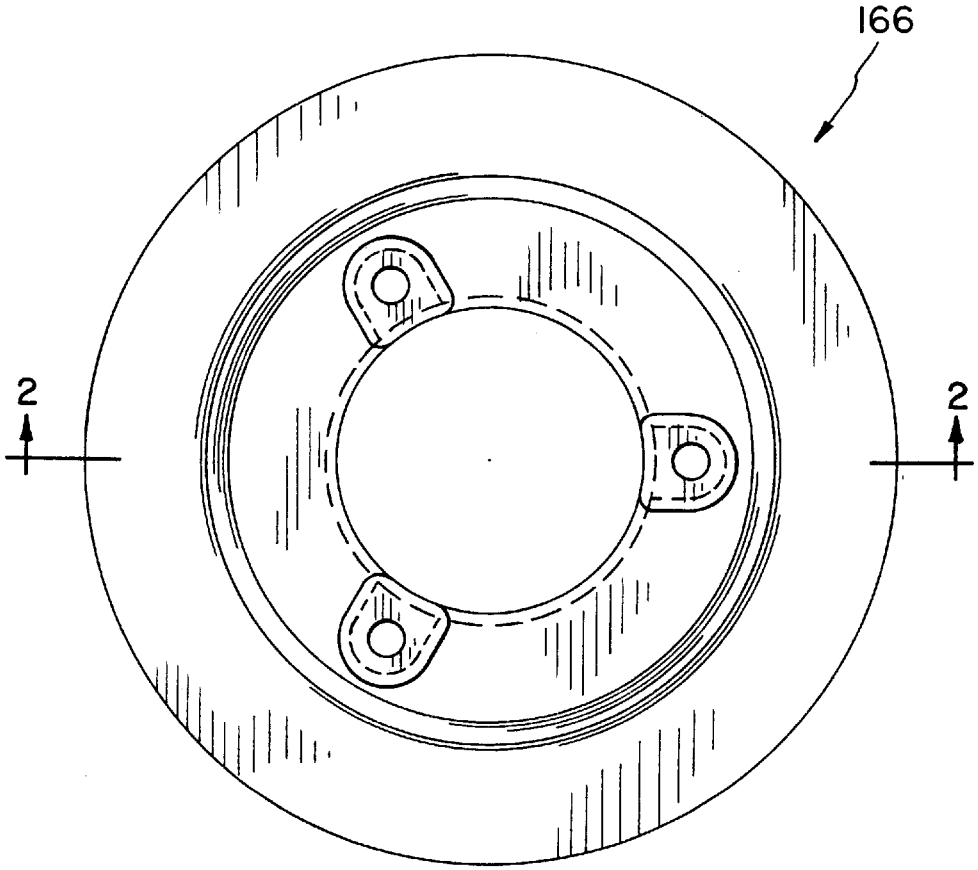
FIG. 3 is a top view of the suction pressure baffle of FIG. 2.

Top muffling chamber 158 communicates with housing upper chamber 54 by means of axial exit passageways 159 and radial ports 161 (FIG. 5) provided in crankcase 46. Referring again to FIG. 1, suction muffler chamber 163 is defined by annular channel 164 and suction muffler baffle plate 166 (FIGS. 2 and 3). Baffle plate 166 is mounted at bottom surface 76 of crankcase 46 at a plurality of circumferentially spaced locations such as by bolts in threaded holes.

Figure 4:
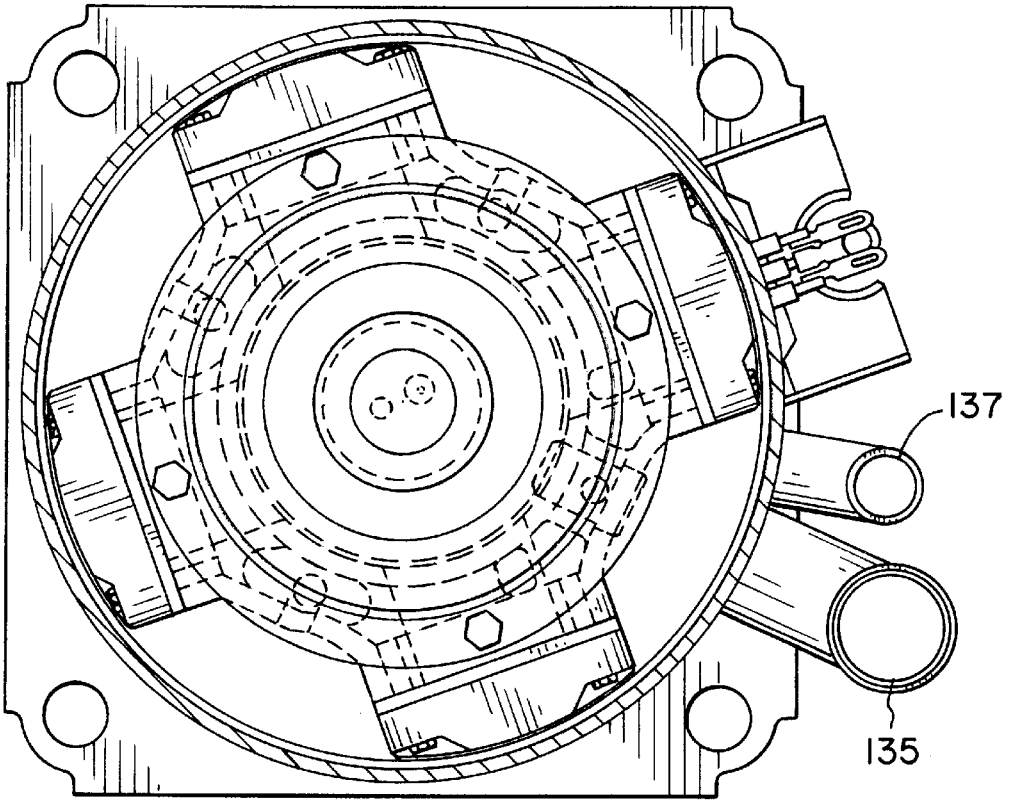
FIG. 4 is a top view of the compressor mechanism of FIG. 1.

Typically, compressor 10 is a component of a closed loop system and is disposed intermediate an evaporator, suction pressure side, which is connected to lower housing chamber 55, and a condenser, discharge pressure side, which is connected to upper housing chamber 54. A portion of the cylinder bores and the rear surfaces of piston assemblies 98 define suction chambers 56. During operation of compressor 10, crankshaft 32 rotates causing piston assemblies 98 to reciprocate within the cylinder bores formed in the crankcase. During the suction phase of the piston stroke, the reciprocating action of the piston causes refrigerant at suction pressure to be drawn into lower housing chamber 55 via suction inlet tube 135 (FIG. 4). Suction gas from lower housing chamber 155 is drawn into muffling chamber 163 via annular opening 165 defined by muffling plate 166 and bearing hub 167 formed in crankcase 46. Suction gas from muffling chamber 163 is drawn into suction cavity 60 and suction chamber 56 via axial passages 57 formed in crankcase 46. Suction valve 99 opens to permit communication of suction gas from suction chamber 56 into compression chamber 58 via passages 101. The piston stems pass through the suction cavity and are connected to the yoke/crankshaft. In the alternative the suction inlet tube 135 may be connected directly to the compressor mechanism such as at yoke cavity 262, and relatively cool suction gas flows from yoke cavity 262 into lower housing area 55 and surrounds motor 22 to provide cool efficient motor operation. This alternative arrangement would result in quieter compressor operation.

As any given piston assembly 98 starts its compression stroke, the associated suction valve 99, located at the face of the piston, closes and the piston compresses the refrigerant in compression chamber 58. During the compression phase the piston moves from bottom dead center position to top dead center position, thereby compressing gaseous refrigerant within compression chamber 58 and forcing same through the discharge port in valve plate 136, past discharge valve 142, through discharge chamber 154, connecting passage 156, and into common discharge chamber 158.

Figure 5:
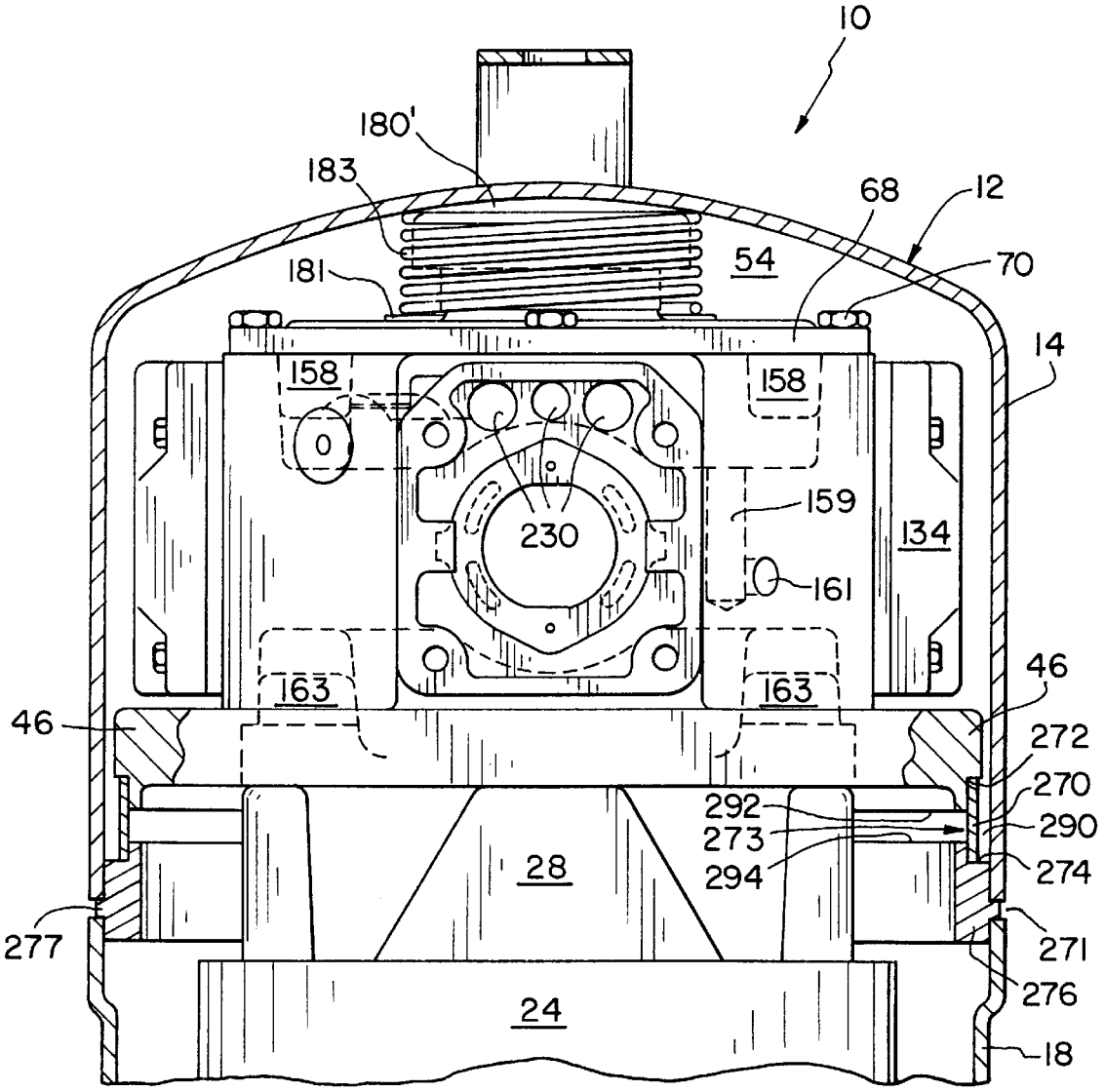
FIG. 5 is a partial sectional view of the compressor of FIG. 1.

As shown in FIG. 5, the compressed refrigerant then travels through passageways 159 and radial ports 161 into upper housing chamber 54. In an alternative arrangement to that shown in FIG. 5, a wall may extend upwardly from plate 68, either separate from or integral with the plate, and a second such plate, again either separate or integral with plate 68 and the wall, disposed over the wall to provide an enclosed area. With openings provided in plate 68, the enclosed area may serve as an additional discharge muffler cavity to further quiet compressor operation. Further, in such a configuration exit ports 161 may be provided in the wall of the second discharge muffler rather than in the crankcase. The additional discharge muffler may be of one, two, or three-piece construction.

The discharge pressure refrigerant exits upper housing chamber 54 via discharge tube 137 and into the condenser portion of the system. Cylinder head gaskets and discharge shock loop connecting tubing are not required in this design because the entire upper housing is at discharge pressure. At the end of the compression cycle, the discharge valve closes and the next suction cycle begins with the suction valve on the piston opening. The above compression process is repeated throughout compressor operation.

FIG. 5 shows connecting passage 156 as comprising a plurality of holes 230 through crankcase 46, associated with each radially disposed cylinder arrangement, to connect between discharge chamber 154 within cylinder head 134 (FIG. 1) and top muffling chamber 158. A suction inlet opening 57 (FIG. 1) is included in crankcase 46, providing communication between suction inlet tube 135 and suction cavity 60.

The high/low pressure compressor of the present invention provides an environment in which the motor and lubrication system are operating at system low or suction pressure condition, which provides for a cool efficient motor and lubrication system. The high temperature portion of the compressor, the compressor mechanism, is in the discharge portion of the system. The valve plate divides the compressor mechanism into a discharge portion and a suction portion, with the compression/suction chamber defined by the cylinder bore being at high, low, or intermediate pressure depending upon the phase of the compression cycle. This provides for a means of allowing the heat of compression to be dissipated to the condenser side of the system via the high pressure portion of the housing as opposed to the evaporator or low side of the system. In this manner, the motor and lubrication system are cooled by the cool suction gas that is returning from the system evaporator. Discharge gas from the compressor flows from the compressor to the system condenser and then to the evaporator for return to the suction or low side of compressor 10.

In this manner, the hermetic housing is divided into separate high discharge pressure and low suction pressure areas and related to the refrigerant system. This division of pressure is accomplished by using the compressor crankcase as it is mounted into the compressor along with a seal cap placed at the end of the crankshaft opposite the sump. Cool, low pressure gas is received and contained in the bottom portion of the compressor, which houses the motor and lubrication system. Accordingly, the motor is surrounded by low temperature suction gas and oil in the sump is in thermal exchange relation with the suction gas. The suction gas maintains a reduced temperature motor operating condition, thereby enhancing motor operation, reliability, and efficiency. The suction gas provides a reduced temperature lubricating oil for delivery to the various bearing and mechanical components of the compressor, thereby enhancing bearing operation, reliability, and life.

Oil returned via suction inlet gas to the lower housing is separated by first being drawn over the motor windings. Further oil separation is accomplished by suction muffler or baffle plate 166, which directs the suction gas to the center of the compressor mechanism and motor/rotor. The upper end of rotor 26 is provided with fan-like blade protuberances that face the baffle plate and help separate the oil from the suction gas. As rotor 26 turns, it acts as a centrifuge and separates oil and liquid refrigerant from the suction gas and reduces refrigerant-oil slugging that can occur during start-up and running operation. After the suction gas is drawn through opening 165 and into suction muffler cavity 163, the suction gas is drawn into the compression cylinders via ports in the cylinders as discussed above.

In one embodiment, suction refrigerant enters compressor 10 via an inlet provided through lower housing portion 18 and occupies low pressure area 55. From low pressure area 55, suction refrigerant is drawn into the compressor unit. During compressor operation, piston assemblies 98, or comparable components in different compressor types, permit suction refrigerant contained in suction area 56 of yoke cavity 262, by operation of suction intake valves or the like, to flow from suction area 56 into compression chamber 58. The pistons then act on the refrigerant contained in the compression chamber by compressing the refrigerant to a discharge pressure. The refrigerant is then discharged through valving mechanisms 142 or the like into discharge chamber 154. The action of the pistons results in a pressure drop within yoke cavity 262 which is seen at crankcase passages 57. This pressure drop draws refrigerant from the low pressure area surrounding the motor into suction muffler chamber 163 via annular opening 165 and then into suction area 60 of yoke cavity 262. In essence, during compressor operation there are three separate areas at different levels of low pressure within the overall low pressure section of the compressor. Yoke cavity 262 is at a first low pressure level that is generally somewhat lower than a second low pressure level in suction muffler chamber 163 that is generally somewhat lower than a third low pressure level in low pressure area 55 surrounding motor 22. Fan-blade like protuberances located at the top of rotor 26 create a centrifugal effect that acts upon the liquid refrigerant forcing it outward through gap 169 formed between the upper surface of windings 28 of stator 24 and baffle plate 166 into lower housing chamber 55. This enhances compressor operation and efficiency by reducing liquid slugging from occurring. One alternative arrangement is to connect the source of suction refrigerant directly with the compressor unit, such as providing an inlet through upper housing portion 14 and directly into yoke cavity 262.

With respect to the lubrication system employed in compressor 10, examples of particular lubrication systems used in refrigeration compressors are described in more detail in U.S. Pat. No. 5,232,351 (Robertson, et al.), relating to a lubrication system used in a reciprocating type compressor, U.S. Pat. No. 5,131,828 (Richardson, Jr, et al.), relating to a lubrication system in a scroll compressor, and U.S. Pat. No. 5,785,151 (Fry et al.) The referenced patents are assigned to the assignee of the present invention and are hereby incorporated into this document by reference.

As the oil lubrication system of compressor 10 is disposed in the low suction pressure area of the compressor, oil delivered to compressor mechanism components is preferably maintained at low pressure. If the oil lubrication path were permitted to be in communication with the high discharge pressure area, the pressure differential would greatly reduce the ability of the lubrication system to deliver oil to the parts in need of lubrication. Accordingly, seal cap 180 is provided at upper end 182 of crankshaft 32. As shown in FIG. 1, seal cap 180 is held in place atop hub 184 of bearing cover 68 by crimping the lower end of the seal cap into crimping groove 186 formed in hub 184. In the alternative, as shown in FIG. 5, seal cap 180' may be provided with annular shoulder 181 and may be held in place by a retention spring 183 or spacer or the like. As a third alternative, the seal cap may be formed in or be a part of upper bearing plate 68. As shown in FIG. 7, a second groove is formed in the hub for receiving O-ring seal 188 for sealing the low pressure area defined by the inner surface of the seal cap and the hub from high pressure area 54.

The lubrication system illustrated in FIG. 1 operates as follows, oil pick-up tube 40 is artially disposed within oil sump 36 to draw oil from sump 36 into axial oil passageway 42 of crankshaft 32, and up through offset oil passageway 244. A plurality of lateral passageways 246, in fluid communication with offset oil passageway 244, are provided to communicate lubricating oil from sump 36 to the various moving parts of compressor 10, including piston assemblies 98.

Crankshaft 32 includes counter bore 248 to provide a recess into which oil pick-up tube 40 is disposed. As crankshaft 32 rotates, oil is drawn in through inlet 255 and migrates upward by centrifugal force along the interior wall of the tube and into axial oil passageway 42 of shaft 32 and results in a pressure drop at inlet 255.

Alongside oil passage 244 in upper end portion 245 of the crankshaft is provided vent passage 250, which may be offset with respect to the axis of the crankshaft. Vent passage 250 is partially threaded, or otherwise adapted, to receive hollow bolt 254 having inner passage 252 formed therein. In one alternative, a hollow plug may be simply pressed into the bore that forms vent 250. Seal cup 180 and the upper end of crankshaft 32 form an area, 256, at suction pressure. Passages 250 and 252 provide fluid communication between area 256 and low pressure yoke cavity 262. The reciprocating action of the compressor mechanism, which draws suction fluid into the yoke cavity, causes a pressure drop to occur along passages 250 and 252 and within area 256. This pressure drop, in addition to the centrifugal force associated with the oil pick-up tube, urges oil to flow upward through passageway 244 and into area 256. The rotating action of the crankshaft slings the oil entering area 256 radially outward against the wall of cup 180, or in the alternative a bearing housing portion of hub 184. This also serves as a trap to collect foreign debris material, and thus prevent such debris from damaging the bearing. The oil then travels downward between the inner bore of hub 184 and the outer cylindrical surface of crankshaft 32 and joins oil from the plurality of radial passages 246 which are in fluid communication with offset oil passageway 244 to feed lubricating oil across rotational bearings 258, 260 and to various other compressor components. The oil delivered across bearing 258 then flows into yoke cavity 262 to lubricate various compressor mechanism components and eventually, by operation of gravity, collects in the bottom portion of yoke cavity 262, such as in the cavity formed by channel 264, which may or may not be provided in the crankcase. The head of bolt 254 acts as a dam to prevent the flow of oil from area 256 from bypassing bearing 258 by flowing directly into passages 252 and 250 and into yoke cavity 262. Should area 256 become filled with oil, then some oil will flow directly into yoke cavity 262 via passages 252 and 250. Bearing 260 is lubricated by oil delivered via radial passages 246.

Oil that is collected in channel 264 generally drains by operation of gravity through passages 57 formed in crankcase 46. Rotating counterweight 90 provides a pumping action to aid in removing oil collected in channel 264 from the crankcase. Holes or passages 57 may be drilled or formed in crankcase 46 and provide a return flow path for oil from the yoke cavity to the oil sump. Passages 57 should be sized so that suction gas entering yoke cavity 262 from suction muffler chamber 163 does not effect the flow of oil back to the oil sump and the oil flow does not effect the flow of suction gas. As an alternative to or in addition to passages 57, bolts 265 may be provided with a bore for draining oil from the crankcase through baffle plate 166 to oil sump 36.

As shown in FIGS. 1 and 5, the present invention further involves providing an annular acoustic insulation device 270 intermediate crankcase 46, which is typically made from cast iron, and annular welding ring 276, which is preferably made from steel and welded or otherwise secured to lower and upper housing members 14 and 18 at intersection 271 to hermetically seal same together. A protuberance or tab 277 (FIG. 5) extends from the outermost side surface of the welding ring and into the gap between housing members 14 and 18 at intersection 271 to facilitate the welding or bonding process. With acoustic insulator 270 received in and secured to recess 272 of crankcase 46 and recess 274 of weld ring 276, gap 273 is formed between the crankcase and the weld flange and clearance 290 is formed between the insulator and the housing. It is preferred that a clearance be formed between the housing and the crankcase. The acoustic insulator is preferably made from vibration absorbing materials, such as neoprene-based elastomers, butylene-type elastomers, silicon-based elastomers, dense fiber type elastomers, etc. During normal operation a pressure differential occurs between the upper housing area and the lower housing area causing annular elastomeric insulator 270 to become compressed and gap 273 and clearance 290 to narrow. During abnormal compressor operation an excessively high pressure differential condition may occur that is sufficient to cause crankcase 46 to engage weld ring 276 at respective surfaces 292 and 294, thereby effectively eliminating gap 273. Clearance 290 may become narrowed, but, even during abnormal conditions, is preferably not eliminated, thereby preventing the elastomeric insulator from rubbing against the housing which may cause unnecessary and premature deterioration of the insulator. The insulator prevents the crankcase from engaging the welding ring during normal operation and deflects so as to absorb loads associated with compressor operation. The insulator isolates vibrations from the crankcase and reduces the communication of same to the housing. The elastomer-based insulator has memory and essentially returns to its normal, pre-load shape once a load dissipates.

Figure 6:
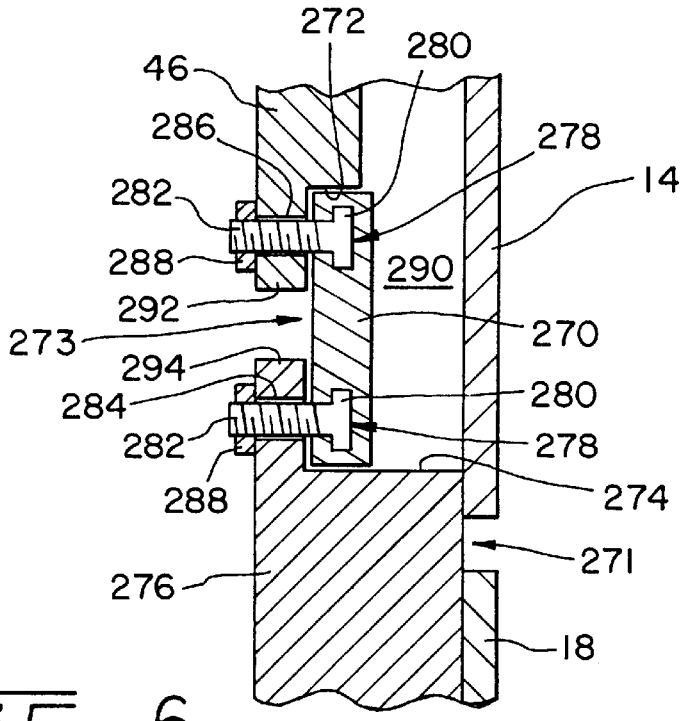
FIG. 6 is a partial sectional view of an alternative to the acoustic insulator arrangement of FIG. 5.

The annular acoustic insulator may be mechanically or otherwise bonded or secured to the crankcase and the annular welding ring, and forms a part of the high to low pressure seal. FIGS. 1 and 5 illustrate a chemical bonding between the insulator and the crankcase and the weld flange at their respective recesses. By way of example and not limitation, acceptable bonding methods include: ultrasonic welding, solvent welding, acrylic adhesive, and hot metal bonding. An example of a mechanical bond between insulator 270 and the crankcase and the weld ring is illustrated in FIG. 6 in which bolts 278 having heads 280 are formed directly in and are encased by elastomeric insulator 270 with threaded lugs 282 extending therefrom. Lugs 282 are received in bores 284 and 286 formed in weld ring 276 and crankcase 46, respectively, and extend therefrom so as to threadingly receive nuts 288. In this manner, insulator 270 is mechanically bonded or attached to the crankcase and the weld ring. Other devices, such as rivets, screws or other fasteners, may be employed to secure insulator 270 to the crankcase and the weld ring.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetic compressor comprising:

a hermetically sealed housing having an oil sump therein;

a reciprocating compressor unit disposed in said housing and adapted to receive and compress refrigerant fluid at a suction pressure and discharge compressed refrigerant fluid at a discharge pressure;

a motor having a stator and a rotor, said rotor rotatably connected to a crankshaft driving connected to said reciprocating compressor unit; and a lubrication system including an oil pump, oil communicated by said oil pump from said oil sump to at least one oil outlet, oil delivered to said reciprocating compressor unit by said at least one oil outlet;

a portion of said reciprocating compressor unit dividing said housing into a high pressure area essentially at discharge pressure, and a low pressure area essentially at suction pressure, said motor and said lubrication system disposed in said low pressure area, and compressed refrigerant fluid being discharged by said compressor unit into said high pressure area.

2. The compressor of claim 1, wherein said reciprocating compressor unit includes a discharge valve, compressed refrigerant forced past said discharge valve into a discharge chamber, said discharge chamber in fluid communication with an inlet to a discharge muffling chamber, an outlet from said discharge muffling chamber in fluid communication with said high pressure area.

3. The compressor of claim 2, wherein said discharge muffling chamber is a primary discharge muffling chamber, and said reciprocating compressor unit includes a secondary discharge muffling chamber, said secondary muffling chamber having an inlet in communication with said outlet from said first discharge muffling chamber and an outlet in fluid communication with said high pressure area.

4. The compressor of claim 1, wherein said reciprocating compressor unit includes a crankcase, said crankcase defining a suction gas cavity therein, said compressor unit subdivides said low pressure area into said suction gas cavity and a low pressure chamber containing said motor and said oil sump, and said crankcase includes a passage therethrough, low pressure gas conveyed from said low pressure chamber to said suction gas cavity through said passage.

5. The compressor of claim 4, further comprising a baffle plate having an opening therein and disposed intermediate said crankcase and said motor, low pressure gas conveyed from said low pressure chamber to said crankcase passage through said baffle plate opening.

6. The compressor of claim 5, wherein said rotor includes a surface proximate said baffle plate, and said rotor surface is adapted to create a centrifugal effect during compressor operation on liquid flowing toward said baffle plate opening, the liquid directed by said centrifugal effect outward through a gap formed between said stator and said baffle plate, whereby slugging of said reciprocating compressor unit may be avoided.

7. The compressor of claim 6, wherein said rotor surface includes fan blade-like protuberances extending therefrom, said centrifugal effect created at least in part by said protuberances.

8. The compressor of claim 1, wherein said reciprocating compressor unit is disposed in said high pressure area.

9. The compressor of claim 1, wherein said lubrication system includes an oil passageway in said crankshaft that extends into said reciprocating compressor unit.

10. The compressor of claim 9, wherein said reciprocating compressor unit includes a crankshaft bearing hub, said oil passageway terminates at a first end of said crankshaft opposite said oil sump, said crankshaft first end received in said bearing hub, said reciprocating compressor unit includes a lubrication oil area proximate said crankshaft first end and isolated from said high pressure area, said lubrication oil area in fluid communication with said oil passageway, said lubrication system providing oil to said lubrication oil area through said oil passageway, a bearing between said crankshaft first end and said bearing hub and in fluid communication with said lubrication oil area lubricated by oil received from said lubrication oil area.

11. The compressor of claim 10, wherein said reciprocating compressor unit includes a crankcase, said crankcase defining a suction gas cavity therein, and said crankshaft first end includes a vent passage, said suction cavity and said lubrication oil area in fluid communication through said vent passage, a pressure differential between said lubrication oil area and said suction cavity created during compressor operation, the flow of lubricating oil through said lubrication system enhanced by said pressure differential.

12. The compressor of claim 11, wherein said crankcase includes a passage therethrough, said crankcase passage in fluid communication with said low pressure area, and lubricating oil delivered to said reciprocating compressor unit is collected in said suction cavity, the oil collected in said suction cavity gravitated toward said oil sump and flowing through said crankcase passage.

13. The compressor of claim 12, further comprising a baffle plate having an opening therein and disposed intermediate said crankcase and said motor, lubricating oil gravitated toward said oil sump from said crankcase passage flowing through said baffle plate opening.

14. The compressor of claim 9, wherein said at least one oil outlet includes a plurality of lateral oil outlets connected to said oil passageway.

15. The compressor of claim 9, wherein said reciprocating compressor unit includes a cylinder block defining at least one cylinder bore, said compressor unit having a piston reciprocating within said cylinder bore and mechanically driven by said crankshaft.

16. An improved lubrication system for use in a hermetic compressor including a hermetically sealed housing having an oil sump therein, a reciprocating compressor unit disposed in the housing and adapted to compress refrigerant fluid received by the compressor unit at a suction pressure and discharge compressed refrigerant fluid at a discharge pressure, the reciprocating compressor unit defining a suction cavity therein, and a motor having a stator and a rotor rotatably connected to a crankshaft driving connected to the compressor unit, a portion of the reciprocating compressor unit dividing the housing into a low pressure area essentially at suction pressure and a high pressure area essentially at discharge pressure, said lubrication system comprising:

an oil pump in fluid communication with the oil sump;

an axial oil passageway provided in the crankshaft and extending into the suction cavity of the reciprocating compressor unit, said oil passageway receiving oil from said oil pump and having at least one oil outlet, lubricating oil being delivered by said at least one oil outlet to a lubrication oil area located adjacent the compressor unit and isolated from the high pressure area; and a vent through which the suction cavity of the reciprocating compressor unit and said oil discharge chamber communicates, a pressure differential between said lubrication oil area and the suction cavity of the compressor unit, the flow of lubricating oil through said lubrication system enhanced by said pressure differential.

17. The lubrication system of claim 16, wherein said at least one oil outlet includes a plurality of lateral oil outlets connected to said oil passageway.

18. The lubrication system of claim 16, wherein said reciprocating compressor unit includes a crankcase having a passage therethrough, and lubricating oil delivered to said compressor unit collects in said suction cavity of the compressor unit, the oil collected in said suction cavity gravitates toward said oil sump via said crankcase passage.

19. A hermetic compressor in one of a refrigeration system and an air-conditioning system also having a condenser and an evaporator, said compressor comprising:

a hermetically sealed housing having an oil sump therein;

a reciprocating compressor unit disposed in said housing and adapted to receive and compress refrigerant fluid from the evaporator at a suction pressure and discharge compressed refrigerant fluid at a discharge pressure to the condenser;

a motor having a stator and a rotor, said rotor rotatably connected to a crankshaft driving connected to said reciprocating compressor unit; and a lubrication system including an oil pump, oil from said oil sump being urged by said oil pump through a passage to at least one oil outlet, lubricating oil being provided to said reciprocating compressor unit through said at least one oil outlet;

wherein said reciprocating compressor unit divides said housing into a high pressure area essentially at discharge pressure, and a low pressure area essentially at suction pressure, said motor and said lubrication system disposed in said low pressure area, and compressed refrigerant fluid is discharged by said reciprocating compressor unit into said high pressure area, the evaporator coupled to said low pressure area and the condenser coupled to said high pressure area.

* * * * *